United States Patent [19]

Reece

[11] 4,428,132

[45] Jan. 31, 1984

[54] TRENCHING PLOW WITH PLOW CARRIAGE ON CURVED SUPPORTING TRACK

[75] Inventor: Alan R. Reece, Wylam, England

[73] Assignee: The British Petroleum Company p.l.c., London, England

[21] Appl. No.: 416,077

[22] Filed: Sep. 8, 1982

[30] Foreign Application Priority Data

Sep. 11, 1981 [GB] United Kingdom ..... 8127567

[51] Int. Cl.[3] ..... E02F 5/18; F16L 1/04

[52] U.S. Cl. ..... 37/193; 37/98; 405/161; 405/174

[58] Field of Search ..... 37/193, 98, 54; 405/161, 164, 180, 182, 183, 154, 174, 181

[56] References Cited

U.S. PATENT DOCUMENTS

| | | | |
|---|---|---|---|
| 3,024,851 | 3/1962 | Harres | 37/193 |
| 3,170,300 | 2/1965 | Kelley | 405/180 |
| 3,232,358 | 2/1966 | Heiberg | 405/180 |
| 3,664,141 | 5/1972 | Wyatt | 405/174 |
| 3,990,377 | 11/1976 | Marquinez | 405/161 |
| 4,014,175 | 3/1977 | Brink | 37/193 |
| 4,338,043 | 7/1982 | Biancale et al. | 405/154 |

FOREIGN PATENT DOCUMENTS

| | | | |
|---|---|---|---|
| 831233 | 6/1966 | Canada | 405/174 |

*Primary Examiner*—E. H. Eickholt

*Attorney, Agent, or Firm*—Morgan, Finnegan, Pine, Foley & Lee

[57] ABSTRACT

A trenching device for previously laid cable or pipeline, particularly those laid under water, has a plough (1), means (8) for following the cable or pipeline, a carriage (9), which may be a tractor, connected to the plough through a towing member (6), and vertical pivots between the towing member and the plough and the towing member and the carriage.

The double pivot system allows the plough to follow the cable or pipeline independently of the motion of the carriage.

9 Claims, 4 Drawing Figures

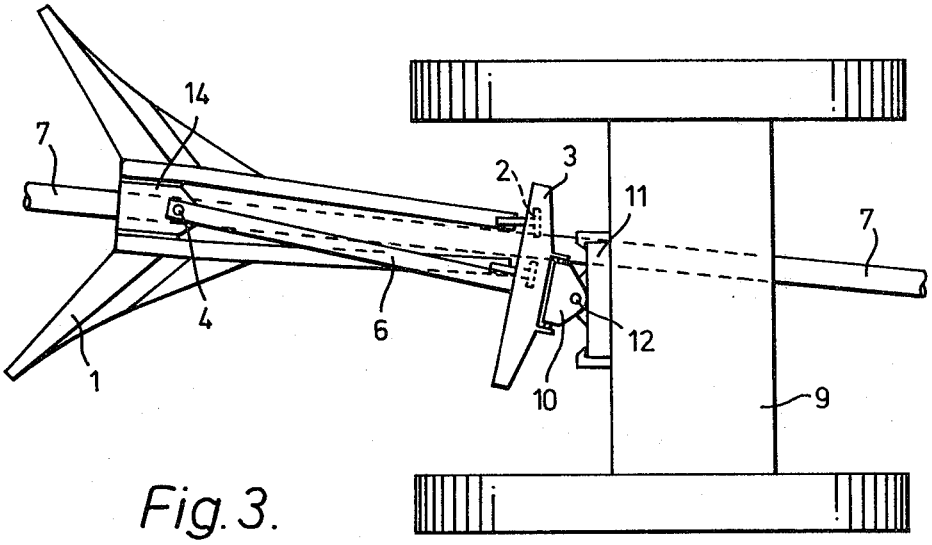
Fig. 3.
Fig. 4.
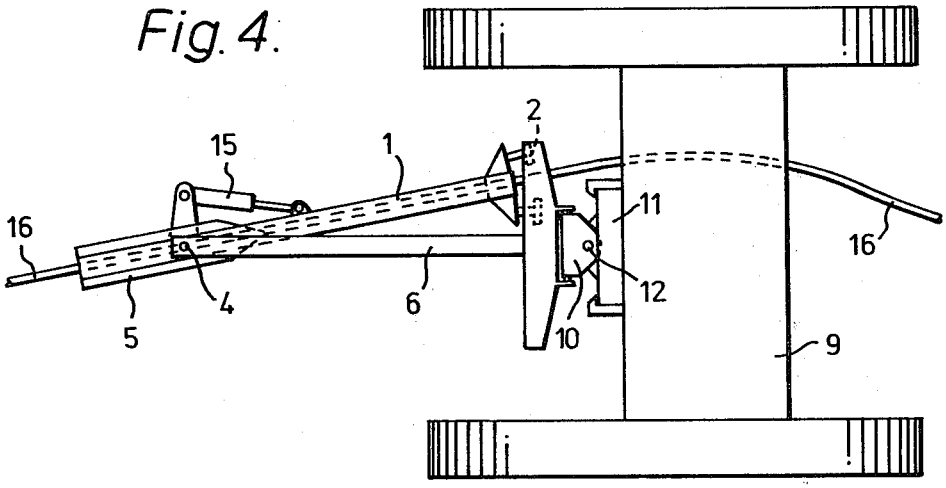

TRENCHING PLOW WITH PLOW CARRIAGE ON CURVED SUPPORTING TRACK

This invention relates to a trenching device for making a trench for a previously laid cable or pipeline particularly cable or pipeline laid at an underwater site. The cutting part of the device may be a mechanical cutter, a jetting cutter or a ploughshare, but the device will hereafter be referred to simply as a plough.

In European Patent Application No. 0 010 915 there is disclosed a towed underwater trenching plough which has means for engaging a previously laid pipeline or cable and a towing member pivotally connected to a hitch point whereby the direction of travel of the plough is, within limits, independent of the direction of travel of the towing vehicle. The hitch point is located above a landside and the advantage of this arrangement is that it reduces the sideways forces exerted on the pipeline or cable by the plough when the line of the towing force is inclined to the direction of travel of the plough.

It is an object of the present invention to provide a plough and carriage therefor suitable for burying a pipeline or cable with only coarse steering of the carriage while the plough follows the cable or pipeline and which has the advantage referred to above.

According to the present invention there is provided a trenching plough and a carriage therefor for making a trench for a previously laid cable or pipeline, the plough having a cutter and means located forward with respect to the cutter for following the previously laid cable or pipeline, the plough being connected to the carriage so that the front of the plough is supported by the carriage, the plough having a towing member by means of which it is drawn by the carriage, there being pivotal movement about a vertical axis between the towing member and the body of the plough and between the towing member and the carriage.

The front of the body of the plough can be supported by and run in a laterally extending curved track supported by the towing member so that the front of the plough can move in an arc within limits set by the track.

Conveniently the front of the towing member and the track can pivot as an assembly also about a horizontal axis with respect to the carriage. For example, a universal joint may provide both pivots.

The carriage can be provided by an underwater tractor. The phrase previously laid cable or pipeline is not intended to exclude the operation in which the cable or pipe is laid and trenched almost immediately, for example a cable or pipe being fed from a surface vessel onto the sea bed just in front of the plough and tractor system.

The plough may have a landside as described, for example, in European patent application No. 0010915, and the pivot at which the towing member is connected to the body of the plough can be located in the region of the rear of the plough so that the line of the towing force passes over or close to the landside.

The invention is illustrated by reference to the accompanying drawings to which:

FIG. 1 is a side elevation of the plough and carriage the latter being provided by a tractor. One track of the tractor has been omitted for clarity. A pipeline is shown passing though the trenching plough.

FIG. 3 is a plan view similar to FIG. 2 with the difference that the tractor is displaced sideways and the direction of travel of the tractor is inclined to the pipeline and hence also the direction of travel of the plough which follows the pipeline.

FIG. 4 is a plan view of the plough and tractor and further illustrates the provision of a hydraulic ram by means of which an oscillatory path can be imparted to the plough.

Figure 1:
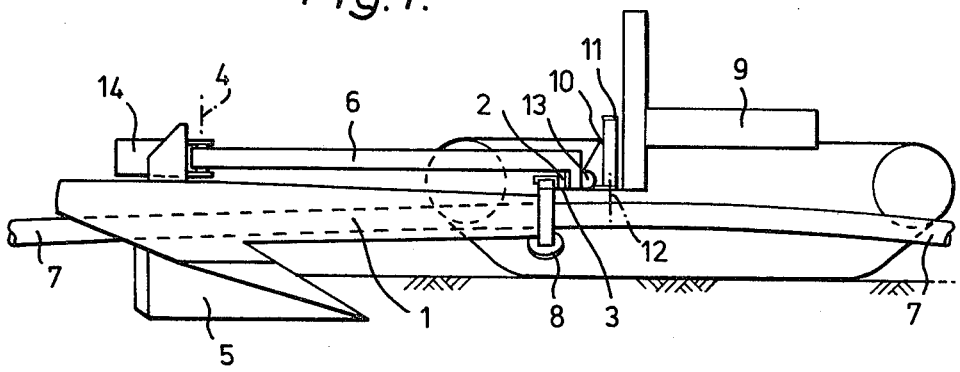
Figure 2:
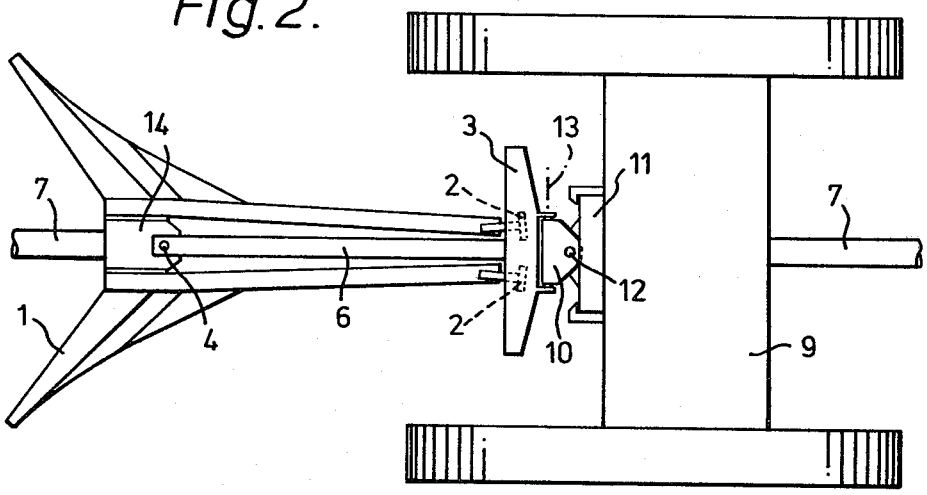
FIG. 2 is a plan view of the plough and tractor illustrated in FIG. 1.

Referring to the drawings; the trenching plough is indicated generally by reference number 1, and its carriage, in the form of a tractor, by reference number 9. The plough 1 has a towing member in the form of a boom 6 by means of which it is drawn by the tractor 9. The boom 6 can pivot about a vertical pivot 4 with respect to the body of the plough and also about pivot 12 with respect to the tractor 9. The plough 1 is supported at its front by rollers 2 running in a horizontal curved track 3 rigidly fixed to the boom 6. The body of plough 1 can thus rotate about a vertical axis by means of the pivot 4 which is located in the region of the rear of the plough above a landside 5. The plough 1 encloses a pipeline 7 and supports it on angled rollers 8.

The boom 6 and track 3 is attached as an assembly to the tractor 9 by a universal joint 10 and a slider 11. The universal joint 10 provides the vertical pivot 4, and also allows the plough the pitch about a lateral axis 13 relative to the tractor 9. The slider 11 provides the means for adjusting the depth of cut of the plough 1.

In operation the tractor 9 trails the plough 1 behind it with all pivots free. The location of pivot 4 as disclosed in European Patent Application No. 0 010 915 ensures that the plough 1 can be steered by relatively small forces obtained from the pipeline 7 via the angled pipe support rollers 8. It is therefore only necessary to steer the tractor 9 so that the plough 1 remains within the broad limits set by the width of the track 3 and does not contact any part of the tractor 9. The plough 1 accurately follows the pipeline and does not impose large lateral forces on it.

The system described has the following advantages: it not only allows the plough to follow the pipeline with considerable independence of the motion of the tractor but also provides all the necessary restraints and controls in the connection of the plough to the tractor. By the addition of a suitable hydraulic ram arrangement between the tractor 9 and the boom 6 the plough 1 may be lifted out of work and transported fully mounted on the tractor 9. By moving the drawbar slider 11 up and down relative to the tractor frame 9 the depth of cut made by the plough 1 may be varied and controlled. The plough can be prevented from rolling relative to the tractor 9 by the torsional stiffness of the boom 6 and rollers 2 in the double sided track 3. Furthermore the arrangement provides a convenient possibility of disconnecting the plough 1 from the tractor 9 by separation between the sub frame 14 and plough 1 and rearward withdrawal of the rollers 2 from the track 3. The tractor and boom carrying all of the hydraulic equipment can then be removed from the pipeline 7 for repair leaving only the plough which can easily be removed separately later.

The addition of hydraulic rams capable of forcing rotation at pivots 4 and 12 makes it possible to position the plough relative to the tractor, which is useful particularly when engaging the plough with the pipeline. These rams are allowed to "float" when the system is working.

Instead of the cable or pipe being carried on the plough through rollers 8, it can be left lying on the ground. Sliders or non contracting sensors may replace the rollers or the latter may be modified to rotate on vertical axes so that only horizontal forces are exerted on the plough.

The system described has a further useful capability. When burying a flexible cable a problem can arise if the cable is lying on the ground in a slack state. The plough will tend to accumulate the slack in front of it until a loop is formed which jams in the mouth of the plough, and the cable can be damaged. One way to avoid this is to drive the plough on an approximately oscillatory path increasing the trench length and consuming the slack. This cannot satisfactorily be done by steering the tractor on a oscillatory path for two reasons. If the tractor is a tracklayer then steering requires slewing of the tracks on the ground which in turn requires large tractive forces which usually result in track slip and often in imobilization of the vehicle. Furthermore the tractor is often required to follow a particular defined track and also has to be steered so that it does not run over the cable on the ground. It is therefore convenient to force the plough to swing laterally across the path of the tractor. This cannot be done by swinging on a single pivot on the tractor, because the plough acts as a rudder and either steers the tractor or requires undesirable use of the tractors own steering to maintain a straight course.

All of these problems are overcome by the use of the system described in this patent with the addition of a hydraulic ram shown at 15 on FIG. 4. This FIG. shows a cable plough burying a slack flexible cable 16. When the ram 15 has been activated to rotate the plough 1 relative to the boom 6 about the axis 4 as shown, the plough will rapidly swing in a clockwise direction due to the sideforces on the long landside surface 5 until the plough 1 is parallel to the motion of the tractor 9. The ram 15 can then be activated to rotate the plough in the opposite sense relative to the boom causing it to swing back to the opposite side. In this way an approximately sinusoidal track can be obtained by successive extensions and contractions of ram 15. Because the plough is always free to pivot about the axis 12 no steering couples are applied to the tractor so that it steers easily without any traction problems.

For this use it is not necessary that the plough boom is carried in the roller track at the front. The connection between plough and boom can simply be a deep strong hinge at 4. However, in practice the arrangement described above can be stronger and more convenient.

I claim:

1. A trenching plough and a carriage therefor for making a trench for a previously laid cable or pipeline, the plough having a cutter and means located forward with respect to the cutter for following the previously laid cable or pipeline, the plough being connected to the carriage so that the front of the plough is supported by the carriage, the plough having a towing member by means of which it is drawn by the carriage, there being pivotal movement about a vertical axis between the towing member and the body of the plough and between the towing member and the carriage, the front of the body of the plough running in a latterally extending curved track supported by the towing member so that the front of the plough can move in an arc within the limits set by the track.

2. A trenching plough as claimed in claim 1 wherein the front of the plough and the curved track can pivot as an assembly also about a horizontal axis with respect to the carriage.

3. A trenching plough as claimed in claim 2 wherein the assembly is connected to the carriage by a universal joint.

4. A trenching plough and carriage as claimed in claim 1 wherein the plough has a landside, and the pivot at which the towing member is connected to the body of the plough is located in the region of the rear of the plough so that the line of the towing force passes over or close to the landside.

5. A trenching plough as claimed in claim 1 which further comprises means for lifting the plough out of a working position.

6. A trenching plough as claimed in claim 5 wherein said means comprises a hydraulic ram.

7. A trenching plough as claimed in claim 1 wherein the towing member is disconnectable from the plough so that the member and carriage can be removed from the cable or pipe in the event of emergency or breakdown.

8. A trenching plough as claimed in claim 7 wherein the front of the plough is disconnectable from the curved track.

9. A cable trenching plough as claimed in claim 1 wherein the plough has means for controllably rotating the plough relative to the towing member whereby the plough can be directed in a meandering path to take up slack in the cable.

* * * * *